US009267093B2

(12) United States Patent
Iyer et al.

(10) Patent No.: US 9,267,093 B2
(45) Date of Patent: Feb. 23, 2016

(54) METHODS FOR PROVIDING STEEL-ON-STEEL FRICTION AND/OR STEEL-ON-PAPER FRICTION WITH LUBRICANT COMPOSITIONS FOR POWER TRANSMITTING FLUIDS

(75) Inventors: Ramnath N. Iyer, Glen Allen, VA (US); Samuel H. Tersigni, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 12/784,696

(22) Filed: May 21, 2010

(65) Prior Publication Data

US 2010/0279901 A1 Nov. 4, 2010

Related U.S. Application Data

(60) Division of application No. 11/838,985, filed on Aug. 15, 2007, now abandoned, which is a continuation of application No. 10/705,316, filed on Nov. 10, 2003, now abandoned.

(51) Int. Cl.
*C10M 169/04* (2006.01)
*C10M 163/00* (2006.01)

(52) U.S. Cl.
CPC ..... *C10M 163/00* (2013.01); *C10M 2207/027* (2013.01); *C10M 2207/028* (2013.01); *C10M 2207/144* (2013.01); *C10M 2207/26* (2013.01); *C10M 2207/262* (2013.01); *C10M 2215/16* (2013.01); *C10M 2215/28* (2013.01); *C10M 2217/043* (2013.01); *C10M 2219/044* (2013.01); *C10M 2219/046* (2013.01); *C10N 2210/01* (2013.01); *C10N 2210/02* (2013.01); *C10N 2230/04* (2013.01); *C10N 2230/42* (2013.01); *C10N 2230/76* (2013.01); *C10N 2240/04* (2013.01); *C10N 2240/045* (2013.01); *C10N 2240/08* (2013.01); *C10N 2260/12* (2013.01); *C10N 2260/14* (2013.01)

(58) Field of Classification Search
CPC ..... C10M 169/04
USPC ..... 508/188, 161, 155, 187
See application file for complete search history.

(56) References Cited

U.S. PATENT DOCUMENTS

| | | | |
|---|---|---|---|
| 2,459,112 | A | 1/1949 | Oberright |
| 2,962,442 | A | 11/1960 | Andress |
| 2,984,550 | A | 5/1961 | Chamot |
| 3,036,003 | A | 5/1962 | Arthur |
| 3,087,936 | A | 4/1963 | LeSuer |
| 3,163,603 | A | 12/1964 | LeSuer |
| 3,166,516 | A | 1/1965 | Kirkpatrick |
| 3,172,892 | A | 3/1965 | LeSuer et al. |
| 3,184,474 | A | 5/1965 | Catto et al. |
| 3,202,678 | A | 8/1965 | Stuart et al. |
| 3,215,707 | A | 11/1965 | Rense |
| 3,216,936 | A | 11/1965 | LeSuer |
| 3,219,666 | A | 11/1965 | Norman et al. |
| 3,236,770 | A | 2/1966 | Matson et al. |
| 3,254,025 | A | 5/1966 | LeSuer |
| 3,271,310 | A | 9/1966 | LeSuer |
| 3,272,746 | A | 9/1966 | LeSuer |
| 3,275,554 | A | 9/1966 | Wagenaar |
| 3,281,357 | A | 10/1966 | Vogel |
| 3,281,428 | A | 10/1966 | LeSuer |
| 3,282,955 | A | 11/1966 | LeSuer |
| 3,306,908 | A | 2/1967 | LeSuer |
| 3,311,558 | A | 3/1967 | Prizer et al. |
| 3,316,177 | A | 4/1967 | Dorer, Jr. |
| 3,331,776 | A | 7/1967 | Krukziener |
| 3,338,832 | A | 8/1967 | LeSuer |
| 3,340,281 | A | 9/1967 | Brannen, Jr. |
| 3,341,542 | A | 9/1967 | LeSuer et al. |
| 3,344,069 | A | 9/1967 | Stuebe |
| 3,346,493 | A | 10/1967 | LeSuer |
| 3,351,552 | A | 11/1967 | LeSuer |
| 3,355,270 | A | 11/1967 | Amick |
| 3,368,972 | A | 2/1968 | Otto |
| 3,381,022 | A | 4/1968 | LeSuer |
| RE26,433 | E | 8/1968 | LeSuer |
| 3,399,141 | A | 8/1968 | Clemens |
| 3,413,347 | A | 11/1968 | Worrel |
| 3,415,750 | A | 12/1968 | Anzenberger |
| 3,433,744 | A | 3/1969 | LeSuer |
| 3,438,757 | A | 4/1969 | Honnen et al. |

(Continued)

FOREIGN PATENT DOCUMENTS

| | | |
|---|---|---|
| CA | 2372227 | 11/2000 |
| EP | 0384639 | 8/1990 |

(Continued)

OTHER PUBLICATIONS

Non-Final Office Action: mailed on Jun. 6, 2006 for U.S. Appl. No. 10/705,316.

(Continued)

*Primary Examiner* — Cephia D Toomer
*Assistant Examiner* — Chantel Graham
(74) *Attorney, Agent, or Firm* — Mendelsohn Dunleavy, PC

(57) ABSTRACT

An additive composition may comprise at least one phosphorus- and boron-containing dispersant, at least one boron-containing dispersant, and at least one detergent. Such composition may be useful in power transmissions to provide improved anti-shudder performance and/or improved friction durability.

20 Claims, No Drawings

(56) References Cited

U.S. PATENT DOCUMENTS

| | | | | |
|---|---|---|---|---|
| 3,442,808 | A | | 5/1969 | Traise et al. |
| 3,444,170 | A | | 5/1969 | Norman et al. |
| 3,448,047 | A | | 6/1969 | Traise et al. |
| 3,448,048 | A | | 6/1969 | LeSuer et al. |
| 3,448,049 | A | | 6/1969 | Preuss et al. |
| 3,451,933 | A | | 6/1969 | Leister |
| 3,454,497 | A | | 7/1969 | Witnner |
| 3,454,555 | A | | 7/1969 | van der Voort |
| 3,454,607 | A | | 7/1969 | LeSuer et al. |
| 3,459,661 | A | | 8/1969 | Schlobohm |
| 3,461,172 | A | | 8/1969 | Previc |
| 3,467,668 | A | | 9/1969 | Gruber et al. |
| 3,493,520 | A | | 2/1970 | Verdol et al. |
| 3,501,405 | A | | 3/1970 | Willette |
| 3,522,179 | A | | 7/1970 | LeSuer |
| 3,533,945 | A | | 10/1970 | Vogel |
| 3,539,633 | A | | 11/1970 | Piasek et al. |
| 3,541,012 | A | | 11/1970 | Stuebe |
| 3,542,680 | A | | 11/1970 | LeSuer |
| 3,543,678 | A | | 12/1970 | Hobbs, Jr. |
| 3,558,743 | A | | 1/1971 | Verdol et al. |
| 3,565,804 | A | | 2/1971 | Honnen et al. |
| 3,567,637 | A | | 3/1971 | Sabol |
| 3,574,101 | A | | 4/1971 | Murphy |
| 3,576,743 | A | | 4/1971 | Widmer et al. |
| 3,586,629 | A | | 6/1971 | Otto et al. |
| 3,591,598 | A | | 7/1971 | Traise et al. |
| 3,600,372 | A | | 8/1971 | Udelhofen et al. |
| 3,630,904 | A | | 12/1971 | Musser et al. |
| 3,632,510 | A | | 1/1972 | LeSuer |
| 3,632,511 | A | | 1/1972 | Chien-Wei |
| 3,634,515 | A | | 1/1972 | Piasek et al. |
| 3,649,229 | A | | 3/1972 | Otto |
| 3,658,836 | A | | 4/1972 | Vineyard |
| 3,697,428 | A | | 10/1972 | Meinhardt et al. |
| 3,697,574 | A | | 10/1972 | Piasek et al. |
| 3,703,536 | A | | 11/1972 | Piasek et al. |
| 3,704,308 | A | | 11/1972 | Piasek et al. |
| 3,718,663 | A | | 2/1973 | Piasek et al. |
| 3,725,277 | A | | 4/1973 | Worrel |
| 3,725,441 | A | | 4/1973 | Murphy |
| 3,725,480 | A | | 4/1973 | Traise et al. |
| 3,726,882 | A | | 4/1973 | Traise et al. |
| 3,736,357 | A | | 5/1973 | Piasek et al. |
| 3,751,365 | A | | 8/1973 | Piasek et al. |
| 3,756,953 | A | | 9/1973 | Piasek et al. |
| 3,793,202 | A | | 2/1974 | Piasek et al. |
| 3,798,165 | A | | 3/1974 | Piasek et al. |
| 3,798,247 | A | | 3/1974 | Piasek et al. |
| 3,803,039 | A | | 4/1974 | Piasek et al. |
| 3,804,763 | A | | 4/1974 | Meinhardt |
| 3,836,471 | A | | 9/1974 | Miller |
| 3,862,981 | A | | 1/1975 | Demoures et al. |
| 3,936,480 | A | | 2/1976 | Demoures et al. |
| 3,948,800 | A | | 4/1976 | Meinhardt |
| 3,950,341 | A | | 4/1976 | Okamoto et al. |
| 3,957,854 | A | | 5/1976 | Miller |
| 3,957,855 | A | | 5/1976 | Miller |
| 3,980,569 | A | | 9/1976 | Pindar et al. |
| 3,991,098 | A | | 11/1976 | Okamoto |
| 4,071,548 | A | | 1/1978 | Okamoto |
| 4,173,540 | A | | 11/1979 | Lonstrup et al. |
| 4,234,435 | A | | 11/1980 | Meinhardt et al. |
| 4,455,243 | A | | 6/1984 | Liston |
| 4,652,387 | A | | 3/1987 | Andrewss, Jr. et al. |
| 5,089,156 | A | * | 2/1992 | Chrisope et al. ..... 508/161 |
| 5,137,980 | A | | 8/1992 | Degonia et al. |
| 5,198,133 | A | | 3/1993 | Papay |
| 5,256,324 | A | | 10/1993 | Papay |
| 5,344,579 | A | | 9/1994 | Ohtani et al. |
| 5,389,273 | A | | 2/1995 | Papay |
| 5,439,606 | A | | 8/1995 | Papay |
| 5,578,236 | A | * | 11/1996 | Srinivasan et al. ..... 508/188 |
| 5,620,948 | A | | 4/1997 | Tipton |
| 6,184,185 | B1 | | 2/2001 | Taguchi et al. |
| 6,225,266 | B1 | | 5/2001 | Watts et al. |
| 6,337,309 | B1 | | 1/2002 | Watts et al. |
| 6,426,323 | B1 | | 7/2002 | Sato et al. |
| 6,451,745 | B1 | | 9/2002 | Ward |
| 6,482,778 | B2 | | 11/2002 | Tersigni et al. |
| 2001/0034305 | A1 | | 10/2001 | Komatsubara |
| 2002/0151441 | A1 | * | 10/2002 | Srinivasan et al. ..... 508/188 |
| 2003/0013619 | A1 | | 1/2003 | Sato et al. |
| 2003/0148895 | A1 | * | 8/2003 | Robson et al. ..... 508/155 |

FOREIGN PATENT DOCUMENTS

| | | |
|---|---|---|
| EP | 0531000 | 3/1993 |
| EP | 0919605 | 6/1999 |
| EP | 1076087 | 2/2001 |
| EP | 1233054 | 8/2002 |
| EP | 1344814 | 9/2003 |
| JP | 02-289691 | 11/1990 |
| JP | 05-263090 | 10/1993 |
| JP | 2000-109873 | 4/2000 |
| JP | 2001-279286 | 10/2001 |
| JP | 2001-342486 | 12/2001 |
| WO | 03095595 | 11/2003 |

OTHER PUBLICATIONS

Final Rejection: mailed on Jun. 9, 2007 for U.S. Appl. No. 10/705,316.

Non-Final Office Action: mailed on Jun. 23, 2009 for U.S. Appl. No. 11/838,985.

Final Rejection: mailed on Jun. 22, 2010 for U.S. Appl. No. 11/838,985.

Advisory Action: mailed on Mar. 26, 2010 for U.S. Appl. No. 11/838,985.

* cited by examiner

METHODS FOR PROVIDING STEEL-ON-STEEL FRICTION AND/OR STEEL-ON-PAPER FRICTION WITH LUBRICANT COMPOSITIONS FOR POWER TRANSMITTING FLUIDS

RELATED APPLICATIONS

The present application is a divisional of and claims the benefit of priority to U.S. application Ser. No. 11/838,985 filed on Aug. 15, 2007 now abandoned which is a continuation of and claims the benefit of priority to U.S. application Ser. No. 10/705,316, filed on Nov. 10, 2003 now abandoned.

BACKGROUND

Compositions according to the present disclosure may be useful in a variety of lubricating and power transmitting applications, for example, in automatic transmissions, such as, continuously variable transmitting applications and/or automated manual transmissions, with or without start-up devices, such as torque converters.

There has been a steady growth in the number of automobile manufacturers using or planning to use continuously variable transmissions (CVTs) in place of conventional automatic transmissions. CVTs have been shown to impart improved fuel efficiency and driving performance as well as reduced emissions compared to conventional automatic transmissions.

CVTs may contain a steel push-belt and pulley assembly, a chain and pulley assembly, or a disk assembly (in the case of toroidal CVTs), in combination with a torque converter or some other form of a start-up device. Torque is transmitted through metal-metal contact between the pulley and the belt or chain or disk. Efficient transmission of torque requires relatively high steel-on-steel friction with minimal wear between the belt or chain and the pulley. Low friction can lead to belt slippage or catastrophic wear. Steel-on-steel friction is therefore a critical requirement for transmission of torque. The additive technology employed to raise steel-on-steel friction may lead to higher steel-on-paper friction. In CVT assemblies with torque converters as the start-up device, the presence of the torque converter clutch requires that CVT fluids have an appropriate level of steel-on-paper friction in order to avoid problems that plague transmission fluids with high friction. An example of such a problem is shudder. CVT starting clutches must provide the same functions as those in conventional automatic transmissions in addition to needing to meet the requirements for the CVT. Thus, one of the principal challenges to a formulator developing CVT fluids is balancing steel-on-steel friction requirements with those for steel-on-paper friction.

BRIEF SUMMARY OF EMBODIMENTS

The present disclosure describes fluids that fulfill performance requirements for both steel-on-steel friction and steel-on-paper friction.

In an embodiment of the present disclosure, a method for increasing steel-on-steel friction and stabilizing steel-on-paper friction may comprise lubricating a transmission with a lubricating composition comprising a major amount of a base oil and an additive composition comprising: (a) at least one first phosphorus- and boron-containing dispersant in an amount of about 20 wt % or more in the additive composition; (b) at least one second boron-containing dispersant, free of phosphorus; and (c) at least one metal-containing detergent.

In some embodiments, the first dispersant comprises a phosphorylated and boronated polyisobutylene succinimide, bis-succinimide, or mixture thereof.

In some embodiments, the polyisobutylene has a weight average molecular weight of about 900.

In some embodiments, the second dispersant comprises a boronated polyisobutylene succinimide, bis-succinimide, or mixture thereof.

In some embodiments, the polyisobutylene has a weight average molecular weight of about 900 to about 1300.

In some embodiments, the detergent comprises an overbased detergent.

In some embodiments, the detergent comprises a sulfonate or a phenate.

In some embodiments, the detergent comprises one or more of calcium sulfonate, magnesium sulfonate, sodium sulfonate, calcium phenate, and zinc phenate.

In some embodiments, the detergent comprises a calcium sulfonate having about 1.5 wt % to about 20 wt % calcium.

In some embodiments, the calcium sulfonate comprises a TBN of about 250 mgKOH/g to about 450 mgKOH/g.

In some embodiments, the detergent comprises a calcium phenate having about 2.5 wt % to about 8.5 wt % calcium.

In some embodiments, the detergent comprise a calcium phenate having a TBN of about 50 mgKOH/g to about 300 mgKOH/g.

In some embodiments, the additive composition further comprises one or more of an antioxidant, an extreme pressure additive, a corrosion inhibitor, an antiwear additive, a metal deactivator, an antifoam agent, a viscosity index improver, a pour point depressant, an air entrainment additive, a metallic detergent, and a seal swell agent.

In some embodiments, the transmission comprises a transmission employing one or more of a slipping torque converter, a lock-up torque converter, a starting clutch and one or more shifting clutches.

In some embodiments, the transmission comprises a belt-type, chain-type, or disk-type continuously variable transmission.

In some embodiments, the lubricating composition has a steel-on-steel coefficient of friction $\mu_{(Mid\ Point)}$ of greater than or equal to about 0.13 and wherein the lubricating composition has a steel-on-paper coefficient of friction $\mu_{20}/\mu_{100}$ of less than or equal to about 1.0.

In some embodiments, the total amount of phosphorus and boron present in the lubricating composition is at least about 708 ppm.

In some embodiments, the total amount of phosphorus in the lubricating composition is at least about 300 ppm.

In some embodiments, the total amount of metal in the lubricating composition is at least about 549 ppm.

In another embodiment, a method of increasing steel-on-steel friction may comprise lubricating a transmission with a lubricating composition comprising a major amount of a base oil and an additive composition comprising: (a) at least one first phosphorus- and boron-containing dispersant in an amount of about 2.0 wt % or more in the fluid; (b) at least one second boron-containing dispersant, free of phosphorus; and (c) at least one metal-containing detergent.

In yet another embodiment, a method of improving anti-shudder may comprise lubricating a transmission having shudder with a lubricating composition comprising a major amount of a base oil and an additive composition comprising: (a) at least one first phosphorus- and boron-containing dispersant in an amount of about 2.0 wt % or more in the fluid; (b) at least one second boron-containing dispersant, free of phosphorus; and (c) at least one metal-containing detergent.

In a further embodiment, a method of stabilizing steel-on-paper friction comprising lubricating a transmission with a lubricating composition comprising a major amount of a base oil and an additive composition comprising: (a) at least one first phosphorus- and boron-containing dispersant in an amount of about 2.0 wt % or more in the fluid; (b) at least one second boron-containing dispersant, free of phosphorus; and (c) at least one metal-containing detergent.

DETAILED DESCRIPTION OF EMBODIMENTS

Embodiments of the present disclosure may comprise a composition containing high levels of dispersants containing boron and phosphorus. Embodiments of the present disclosure may exhibit improved steel-on-steel friction as well as steel-on-paper friction performance capability. The use of high phosphorus and boron levels compared to conventional transmission fluids provides transmission fluids with frictional characteristics advantageous, for example, for automatic transmissions, continuously variable transmissions (CVTs), and/or start-up devices, such as torque converters, that operate in conjunction with CVTs.

CVTs may contain a steel push-belt or chain arranged with a pulley assembly or a disk assembly that operates in combination with a torque converter or some other form of a start-up device. Torque is transmitted through metal-metal contact between the pulley and the belt or chain or between the disk assembly. Efficient transmission of torque requires relatively high steel-on-steel friction with minimal wear between the belt or chain and the pulley. Low friction can lead to belt slippage and even catastrophic wear. Steel-on-steel friction is therefore a critical requirement for transmission of torque. The additive technology employed to raise steel-on-steel friction can potentially lead to higher steel-on-paper friction. In CVT assemblies with start-up devices, such as torque converters, the presence of the start-up device requires that CVT fluids have an appropriate level of steel-on-paper friction. If an appropriate level of steel-on-paper friction is not maintained, problems, such as shudder, may be experienced. Thus one of the principal challenges to a formulator developing CVT fluids is balancing steel-on-steel requirements with those for steel-on-paper.

The present disclosure describes fluid compositions that fulfill performance requirements for both steel-on-steel friction and steel-on-paper friction.

Boron-Containing Dispersant

In an embodiment, an additive composition may comprise at least one boron-containing dispersant, wherein the boron-containing dispersant is free of phosphorus. The borated dispersant may be formed by boronating (borating) an ashless dispersant having basic nitrogen and/or at least one hydroxyl group in the molecule, such as a succinimide dispersant, succinamide dispersant, succinic ester dispersant, succinic ester-amide dispersant, Mannich base dispersant, or hydrocarbyl amine or polyamine dispersant. Methods for the production of the foregoing types of ashless dispersants are known to those skilled in the art and are reported in the patent literature. For example, the synthesis of various ashless dispersants of the foregoing types is described in such patents as U.S. Pat. Nos. 2,459,112; 2,962,442, 2,984,550; 3,036,003; 3,163,603; 3,166,516; 3,172,892; 3,184,474; 3,202,678; 3,215,707; 3,216,936; 3,219,666; 3,236,770; 3,254,025; 3,271,310; 3,272,746; 3,275,554; 3,281,357; 3,306,908; 3,311,558; 3,316,177; 3,331,776; 3,340,281; 3,341,542; 3,346,493; 3,351,552; 3,355,270; 3,368,972; 3,381,022; 3,399,141; 3,413,347; 3,415,750; 3,433,744; 3,438,757; 3,442,808; 3,444,170; 3,448,047; 3,448,048; 3,448,049; 3,451,933; 3,454,497; 3,454,555; 3,454,607; 3,459,661; 3,461,172; 3,467,668; 3,493,520; 3,501,405; 3,522,179; 3,539,633; 3,541,012; 3,542,680; 3,543,678; 3,558,743; 3,565,804; 3,567,637; 3,574,101; 3,576,743; 3,586,629; 3,591,598; 3,600,372; 3,630,904; 3,632,510; 3,632,511; 3,634,515; 3,649,229; 3,697,428; 3,697,574; 3,703,536; 3,704,308; 3,725,277; 3,725,441; 3,725,480; 3,726,882; 3,736,357; 3,751,365; 3,756,953; 3,793,202; 3,798,165; 3,798,247; 3,803,039; 3,804,763; 3,836,471; 3,862,981; 3,936,480; 3,948,800; 3,950,341; 3,957,854; 3,957,855; 3,980,569; 3,991,098; 4,071,548; 4,173,540; 4,234,435; 5,137,980 and Re 26,433, herein incorporated by reference. Other suitable dispersants may be found, for example, in U.S. Pat. Nos. 5,198,133; 5,256,324; 5,389,273; and 5,439,606, herein incorporated by reference. Methods that can be used for boronating the various types of ashless dispersants described above are described in U.S. Pat. Nos. 3,087,936; 3,254,025; 3,281,428; 3,282,955; 3,338,832; 3,344,069; 3,533,945; 3,658,836; 3,703,536; 3,718,663; 4,455,243; and 4,652,387.

In some embodiments, the ashless dispersant may comprise one or more alkenyl succinimides of an amine having at least one primary amino group capable of forming an imide group. The alkenyl succinimides may be formed by conventional methods such as by heating an alkenyl succinic anhydride, acid, acid-ester, acid halide, or lower alkyl ester with an amine containing at least one primary amino group. The alkenyl succinic anhydride may be made readily by heating a mixture of polyolefin and maleic anhydride to about 180°-220° C. The polyolefin may be a polymer or copolymer of a lower monoolefin such as ethylene, propylene, isobutene and the like, having a number average molecular weight in the range of about 900 to about 3000 as determined by gel permeation chromatography (GPC).

Amines which may be employed in forming the ashless dispersant include any that have at least one primary amino group which can react to form an imide group and at least one additional primary or secondary amino group and/or at least one hydroxyl group. A few representative examples are: N-methyl-propanediamine, N-dodecylpropanediamine, N-aminopropyl-piperazine, ethanolamine, N-ethanol-ethylenediamine, and the like.

Suitable amines may include alkylene polyamines, such as propylene diamine, dipropylene triamine, di-(1,2-butylene) triamine, and tetra-(1,2-propylene)pentamine. A further example includes the ethylene polyamines which can be depicted by the formula $H_2N(CH_2CH_2NH)_nH$, wherein n may be an integer from about one to about ten. These include: ethylene diamine, diethylene triamine, triethylene tetramine, tetraethylene pentamine, pentaethylene hexamine, and the like, including mixtures thereof in which case n is the average value of the mixture. These depicted ethylene polyamines have a primary amine group at each end so they may form mono-alkenylsuccinimides and bis-alkenylsuccinimides. Commercially available ethylene polyamine mixtures may contain minor amounts of branched species and cyclic species such as N-aminoethyl piperazine, N,N'-bis(aminoethyl) piperazine, N,N'-bis(piperazinyl)ethane, and like compounds. The commercial mixtures may have approximate overall compositions falling in the range corresponding to diethylene triamine to tetraethylene pentamine. The molar ratio of polyalkenyl succinic anhydride to polyalkylene polyamines may be from about 1:1 to about 2.4:1. The Mannich base ashless dispersants for this use are formed by condensing about one molar proportion of long chain hydrocarbon-substituted phenol with from about 1 to about 2.5 moles of formaldehyde and from about 0.5 to about 2 moles of polyalkylene polyamine.

In some embodiments, the ashless dispersant may comprise the products of the reaction of a polyethylene polyamine, e.g. triethylene tetramine or tetraethylene pentamine, with a hydrocarbon substituted carboxylic acid or anhydride made by reaction of a polyolefin, such as polyisobutene, of suitable molecular weight, with an unsaturated polycarboxylic acid or anhydride, e.g., maleic anhydride, maleic acid, fumaric acid, or the like, including mixtures of two or more such substances.

In some embodiments, the boron-containing dispersant may comprise, for example, a boronated polyisobutylene succinimide or bis-succinimide or a mixture thereof. The polyisobutylene may have a weight average molecular weight from about 210 to about 1300, as a further example from about 900 to 1300, and as an even further example from about 1200 to about 1300.

Boron- and Phosphorus-Containing Dispersant

In an embodiment, an additive composition may comprise at least one phosphorus- and boron-containing dispersant (or, in other words, phosphorylated and boronated dispersant). The phosphorus- and boron-containing dispersant may be prepared by phosphorylating and boronating a dispersant as described above. Further, the phosphorus- and boron-containing dispersant may comprise, a phosphorylated and boronated polyisobutylene succinimide or bis-succinimide or a mixture thereof. The phosphorus- and boron-containing dispersant may comprise a polyisobutylene having a weight average molecular weight of about 900. Further, the phosphorus- and boron-containing dispersant may comprise the reaction product of a polyisobutylene succinimide with a boric acid (i.e., $B(OH)_3$) and a phosphorus acid (i.e., $H_3PO_3$).

The boron- and phosphorus-containing dispersant may be present in an amount of about 2.0 wt % or more in the lubricating composition (or finished fluid). The boron- and phosphorus-containing dispersant may be present in an amount of about 20 wt % in the additive composition.

Detergent

In some embodiments, the additive composition may also comprise a detergent. The detergent may comprise an overbased detergent. The detergent may comprise a sulfonate or a phenate. Further, the detergent may comprise a calcium-containing, a magnesium-containing, or a sodium-containing compound. The detergent may comprise, for example, a calcium sulfonate, a magnesium sulfonate, a sodium sulfonate, a calcium phenate, and/or a zinc phenate. For example, a calcium sulfonate detergent may comprise from about 1.5 wt % to about 20 wt % calcium, or as a further example from about 12 wt % to about 15 wt % calcium. Further, a calcium sulfonate detergent may comprise a total base number (TBN) of from about 3 mgKOH/g to about 450 mgKOH/g, as a further example of from about 250 mgKOH/g to about 400 mgKOH/g, and as an even further example of from about 250 mgKOH/g to about 350 mgKOH/g. A calcium phenate detergent may comprise from about 2.5 wt % to about 8.5 wt % calcium, or for example about 5 wt % calcium. Further, a calcium phenate detergent may comprise a TBN of from about 50 mgKOH/g to about 300 mgKOH/g, or for example, about 150 mgKOH/g.

Embodiments may contain alkali metal detergents and/or alkaline-earth metal detergents in addition or in the alternative to the detergents described above. The alkali and alkaline-earth metal detergents useful in this invention are exemplified by oil-soluble neutral or overbased salts of alkali and alkaline-earth metals with one or more of the following acidic substances (or mixtures thereof): sulfonic acids, carboxylic acids, salicylic acids, alkyl phenols, and sulfurized alkyl phenols.

Oil-soluble neutral alkali and alkaline-earth metal-containing detergents are those detergents that contain stoichiometrically equivalent amounts of alkali and alkaline-earth metal in relation to the amount of acidic moieties present in the detergent. Thus, in general the neutral alkali and alkaline-earth metal detergents will have a low basicity when compared to their overbased counterparts. Methods of preparation of overbased alkali and alkaline-earth metal-containing detergents are known in the art and there are numerous commercially available overbased detergents on the market.

The alkali and alkaline-earth metal detergents include neutral and overbased sodium sulfonates, sodium carboxylates, sodium salicylates, sodium phenates, sulfurized sodium phenates, calcium sulfonates, calcium carboxylates, calcium salicylates, calcium phenates, sulfurized calcium phenates, lithium sulfonates, lithium carboxylates, lithium salicylates, lithium phenates, sulfurized lithium phenates, magnesium sulfonates, magnesium carboxylates, magnesium salicylates, magnesium phenates, sulfurized magnesium phenates, potassium sulfonates, potassium carboxylates, potassium salicylates, potassium phenates, sulfurized potassium phenates. Further detergents suitable for use with embodiments of the present disclosure may be found, for example, in U.S. Pat. No. 6,482,778, herein incorporated by reference.

In some embodiments, the additive composition may be combined with a base oil to provide a power transmitting fluid. Such a power transmitting fluid may comprise a finished fluid.

The boron and phosphorus may be present in an amount of, for example, about 200 ppm or more of total boron and phosphorus in the lubricating composition (or finished fluid). As a further example, the boron and phosphorus may be present in an amount of, for example, about 400 ppm or more of total boron and phosphorus in the lubricating composition.

In another embodiment, an automatic transmission fluid, a continuously variable transmission fluid, a double clutch transmission fluid, or a start-up device fluid, such as a torque converter fluid, may comprise an additive composition disclosed herein. The fluid may be suitable for a conventional automatic transmission such as a step-type automatic transmission including a torque converter.

In another embodiment, a method of increasing steel-on-steel and/or stabilizing steel-on-paper friction may comprise lubricating a transmission with a lubricating transmission composition comprising a major amount of a base oil and an additive composition as described herein.

A lubricating fluid may include other additives, such as, for example, one or more of an extreme pressure agent; an anti-wear agent; an antioxidant or an antioxidant system, such as an amine antioxidant or phenolic antioxidant; a corrosion inhibitor or a corrosion inhibitor system; a metal deactivator; an anti-rust agent; a friction modifier; a dispersant; a detergent; a dye; a seal swell agent; an anti-foam agent; a surfactant; a viscosity index improver; a perfume or odor mask; and any suitable combinations thereof. For example, while friction modifiers may be routinely added to lubricating fluids, the particular type and amount of friction modifier is unique and specific to the needs of each particular application.

Further, the base oil may comprise any suitable base oil or mixture of base oils for a particular application. In some embodiments, additives may be provided in an additive package concentrate. Further, some embodiments may comprise a diluent, e.g., a diluent oil. A diluent may be included to ease blending, solubilizing, and transporting the additive package.

The diluent may be compatible with a base oil and/or the additive package. The diluent may be present in any suitable amount in the concentrate. A suitable diluent may comprise a process oil of lubricating viscosity.

The base oil may comprise a mineral oil, mixture of mineral oils, a synthetic oil, mixture of synthetic oils, or mixtures thereof. Suitable base oils may comprise a Group I, Group II, Group III, Group IV, or Group V base stock. Suitable base oils may be manufactured from the gas-to-liquid process.

Examples

Fluids for testing were prepared in targeted basestocks. The fully formulated fluids were prepared by combining components in the proportions such as those shown in Table 1 below. Table 1 illustrates examples of formulation components and amounts.

TABLE 1

Test fluid components

| Component | Example 1, Wt % | Example 2, Wt % |
|---|---|---|
| Amine Antioxidant(s) | 0-0.6 | 0.2-0.6 |
| Rust Inhibitor(s) | 0.02-0.15 | 0.02-0.15 |
| EP/AW agent(s) | 0.04-1.0 | 0.04-1.0 |
| Antifoam agent(s) | 0.01-0.2 | 0.01-0.2 |
| Friction Modifier(s) | 0-2.0 | 0.005-0.25 |
| Dispersant A | 1-5 | 1-5 |
| Dispersant B | 0-5 | 0-5 |
| Detergent C | 0-5 | 0-5 |
| Seal Swell Agent(s) | 0-10 | 0-10 |
| Polymethacrylate VII | 1-30 | 3-30 |
| Basestock | 60-90 | 60-90 |
| Diluent Oil | 1-30 | 2-5 |

In Table 1, "EP/AW" represents an extreme pressure/anti-wear agent and "Polymethacrylate VII" represents a polymethacrylate viscosity index improver. Further, dispersant A comprised a phosphorylated and boronated dispersant containing about 0.76 wt % phosphorus (P) and about 0.37 wt % boron (B); dispersant B comprised a boronated dispersant containing about 1.3% B; and detergent C comprised calcium sulfonate having a total base number (TBN) of about 300 mg KOH/g.

Steel-on-steel friction was measured using a Falex block-on-ring friction tester. In a Falex tester, the coefficient of friction is measured between a rotating S10 ring and a stationary H60 block under a particular load at a given temperature. Steel-on-steel friction ($\mu$) was measured as a function of increasing speed (v) up to a maximum of about 0.53 m/s. The conditions used were about 1000 N load at about 110° C. between sliding speeds from about 0 to about 0.60 m/s. A steel-on-steel coefficient ($\mu$ in Table 2) of friction of about 0.130 or more is estimated to be indicative of good performance.

Steel-on-paper friction was measured using a Modified Low Speed SAE No. 2 test rig to screen fluids for steel-on-paper friction characteristics at low sliding speeds under high load conditions. A ratio of friction at sliding speeds ($\mu_{20}/\mu_{100}$ and $\mu_{40}/\mu_{300}$ in Table 3) of about 1 or less is considered to be indicative of good antishudder performance.

Table 2 shows steel-on-steel friction results measured at about 0.25 m/s in the Falex tests for examples 1 to 9. Fluids 1-8 and 9-10 were direct comparisons where the only variables are as shown in Table 2. Fluids 1-8 and 9-10 and 11 were comparable with only minor variations in some of the other components in the fluids.

TABLE 2

Steel-on-Steel Friction

| Example | 1 | 2 | 3 | 4 | 5 | 6 | 7 | 8 | 9 | 10 | 11 |
|---|---|---|---|---|---|---|---|---|---|---|---|
| Dispersant A, wt % | 2.00 | 4.00 | 4.00 | 2.00 | 2.00 | 4.00 | 2.00 | 4.00 | 2.00 | 4.00 | 4.50 |
| Dispersant B, wt % | 2.00 | 2.00 | 2.00 | 2.00 | 0.00 | 0.00 | 0.00 | 0.00 | 4.00 | 0.00 | 2.00 |
| Detergent C, wt % | 0.45 | 0.45 | 0.00 | 0.00 | 0.00 | 0.45 | 0.45 | 0.00 | 0.00 | 0.00 | 0.15 |
| Amount of boron (B), ppm | 334 | 408 | 408 | 334 | 74 | 148 | 74 | 148 | 594 | 148 | 427 |
| Amount of phosphorus (P), ppm | 150 | 300 | 300 | 150 | 150 | 300 | 150 | 300 | 150 | 300 | 338 |
| (B + P), ppm | 484 | 708 | 708 | 484 | 224 | 448 | 224 | 448 | 744 | 448 | 764 |
| Ca, ppm | 549 | 549 | 0 | 0 | 0 | 549 | 549 | 0 | 0 | 0 | 183 |
| $\mu$ (Mid Point) | 0.112 | 0.139 | 0.133 | 0.127 | 0.097 | 0.128 | 0.113 | 0.137 | 0.130 | 0.135 | 0.135 |

The measurements in Table 2 indicate that by increasing the amount of dispersant A, steel-on-steel friction is increased (for example, compare Example 5 with Examples 8 and 10). In the absence of detergent C, a higher level of dispersant A is sufficient to increase steel-on-steel friction (see, for example, Examples 3, 8, and 10). Further, the addition of dispersant B to formulations containing detergent C helps to maintain or improve steel-on-steel friction (for example, compare Example 2 with Example 6). Thus, higher levels of phosphorus and boron in the presence of detergent are effective in increasing steel-on-steel friction.

A positive friction vs. speed ($\mu$/v) slope is desired for good anti-shudder durability. Steel-on-paper friction measurements were run on a low speed SAE No. 2 friction rig. Table 3 shows friction values at about 20, about 40, about 100, and about 300 rpm ($\mu_{20}$, $\mu_{40}$, $\mu_{100}$, and $\mu_{300}$, respectively).

TABLE 3

Steel-on-Paper Friction

| Example | 2 | 3 | 4 | 6 | 7 | 8 |
|---|---|---|---|---|---|---|
| Dispersant A, wt % | 4.00 | 4.00 | 2.00 | 4.00 | 2.00 | 4.00 |
| Dispersant B, wt % | 2.00 | 2.00 | 2.00 | 0.00 | 0.00 | 0.00 |
| Detergent C, wt % | 0.45 | 0.00 | 0.00 | 0.45 | 0.45 | 0.00 |
| $\mu_{20}$ | 0.132 | 0.148 | 0.137 | .128 | 0.105 | 0.140 |
| $\mu_{40}$ | 0.135 | 0.148 | 0.139 | .131 | 0.110 | 0.141 |
| $\mu_{100}$ | 0.138 | 0.146 | 0.140 | .134 | 0.114 | 0.138 |
| $\mu_{300}$ | 0.138 | 0.140 | 0.139 | .129 | 0.112 | 0.135 |
| $\mu_{20}/\mu_{100}$ | 0.96 | 1.01 | 0.98 | 0.96 | 0.921 | 1.01 |
| $\mu_{40}/\mu_{300}$ | 0.98 | 1.06 | 1.00 | 1.02 | 0.982 | 1.04 |

An increase in fiction can often result in a negative slope between about 20 and about 100 rpm as well as between about 40 and about 300 rpm as shown in Table 3. For example, Examples 3 and 8 have a $\mu_{20}/\mu_{100}$ value and a $\mu_{40}/\mu_{300}$ value greater than 1.00, indicating a negative slope. A $\mu_{20}/\mu_{100}$ value and a $\mu_{40}/\mu_{300}$ value less than 1.00 indicates a positive slope, as shown in Examples 2, 4, and 7, for example. Thus, Examples that contain Detergent C (e.g., a sulfonated detergent) give lower steel-on-paper friction with a very positive slope (see, for example, Examples 2, 6, and 7). A positive slope is indicative of a transmission without shudder problems, and, therefore, is a desirable feature.

Therefore, the use of detergents in combination with high levels (as defined herein) of boronated/phosphorylated dispersants and boronated dispersants provides a CVT fluid with improved steel-on-paper friction characteristics, despite higher steel-on-steel friction characteristics.

The present disclosure thus provides a composition for increasing steel-on-steel friction using high levels of a boronated and phosphorylated dispersant and a boronated dispersant in combination with a detergent. (Compare, for example, Example 2 and 6 in Table 2 and see, for example, Example 2 in Table 3). Further, this disclosure provides a composition that maintains a high steel-on-steel friction and simultaneously minimizes steel-on-paper friction for improved wet-clutch performance.

The compositions described herein will allow the formulation of transmission fluids with applications in continuously variable transmissions as well as conventional automatic transmissions and with different kinds of start-up clutches.

As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

While the present disclosure has been described in some detail by way of illustration and example, it should be understood that the embodiments are susceptible to various modifications and alternative forms, and are not restricted to the specific embodiments set forth. It should be understood that these specific embodiments are not intended to limit the invention but, on the contrary, the intention is to cover all modifications, equivalents, and alternatives falling within the spirit and scope of the invention.

The invention claimed is:

1. A method for increasing steel-on-steel friction and stabilizing steel-on-paper friction comprising:

providing a lubricating composition comprising a major amount of a base oil and an additive composition comprising:

(a) at least one first phosphorus- and boron-containing dispersant in an amount of about 20 wt % or more in the additive composition;

(b) at least one second boron-containing dispersant, free of phosphorus; and (c) at least one metal-containing detergent, wherein the total amount of metal in the lubricating composition is at least about 549 ppm;

lubricating a transmission with the lubricating composition;

wherein the additive composition further comprises one or more of an antioxidant, an extreme pressure additive, a corrosion inhibitor, an antiwear additive, a metal deactivator, an antifoam agent, a viscosity index improver, a pour point depressant, an air entrainment additive, a metallic detergent, and a seal swell agent, and wherein in the lubricating composition, the first dispersant is present in a concentration range of 1 to 5 wt %, the second dispersant is present in a concentration range of 2.00 to 5 wt % and the detergent is present in a concentration range of 0.15 to 5 wt % based on the total weight of the lubricating composition.

2. The method of claim 1, wherein the first dispersant comprises a phosphorylated and boronated polyisobutylene succinimide, bis-succinimide, or mixture thereof.

3. The method of claim 2, wherein the polyisobutylene has a weight average molecular weight of about 900.

4. The method of claim 1, wherein the second dispersant comprises a boronated polyisobutylene succinimide, bis-succinimide, or mixture thereof.

5. The method of claim 4, wherein the polyisobutylene has a weight average molecular weight of about 900 to about 1300.

6. The method of claim 1, wherein the detergent comprises an overbased detergent.

7. The method of claim 1, wherein the detergent comprises a sulfonate or a phenate.

8. The method of claim 1, wherein the detergent comprises one or more of calcium sulfonate, magnesium sulfonate, sodium sulfonate, calcium phenate, and zinc phenate.

9. The method of claim 1, wherein the detergent comprises a calcium sulfonate having about 1.5 wt % to about 20 wt % calcium.

10. The method of claim 9, wherein the calcium sulfonate comprises a TBN of about 250 mgKOH/g to about 450 mgKOH/g.

11. The method of claim 1, wherein the detergent comprises a calcium phenate having about 2.5 wt % to about 8.5 wt % calcium.

12. The method of claim 1, wherein the detergent comprises a calcium phenate having a TBN of about 50 mgKOH/g to about 300 mgKOH/g.

13. The method of claim 1, wherein the transmission comprises a transmission employing one or more of a slipping torque converter, a lock-up torque converter, a starting clutch and one or more shifting clutches.

14. The method of claim 13, wherein the transmission comprises a belt-type, chain-type, or disk-type continuously variable transmission.

15. A method of increasing steel-on-steel friction comprising:

providing a transmission with a lubricating composition comprising a major amount of a base oil and an additive composition comprising:

(a) at least one first phosphorus- and boron-containing dispersant;

(b) at least one second boron-containing dispersant, free of phosphorus; and (c) at least one metal-containing detergent, wherein the total amount of metal in the lubricating composition is at least about 549 ppm;

lubricating a transmission with the lubricating composition;

wherein the additive composition further comprises one or more of an antioxidant, an extreme pressure additive, a corrosion inhibitor, an antiwear additive, a metal deactivator, an antifoam agent, a viscosity index improver, a pour point depressant, an air entrainment additive, a metallic detergent, and a seal swell agent, and wherein in the lubricating composition, the first dispersant is present in a concentration range of 1 to 5 wt %, the second dispersant is present in a concentration range of 2.00 to 5 wt % and the detergent is present in a concentration range of 0.15 to 5 wt % based on the total weight of the lubricating composition.

16. A method of improving anti-shudder comprising:

providing a transmission having shudder with a lubricating composition comprising a major amount of a base oil and an additive composition comprising:

(a) at least one first phosphorus- and boron-containing dispersant in an amount of;

(b) at least one second boron-containing dispersant, free of phosphorus; and (c) at least one metal-containing detergent, wherein the total amount of metal in the lubricating composition is at least about 549 ppm;

lubricating a transmission with the lubricating composition;

wherein the additive composition further comprises one or more of an antioxidant, an extreme pressure additive, a corrosion inhibitor, an antiwear additive, a metal deactivator, an antifoam agent, a viscosity index improver, a pour point depressant, an air entrainment additive, a metallic detergent, and a seal swell agent, and wherein in the lubricating composition, the first dispersant is present in a concentration range of 1 to 5 wt %, the second dispersant is present in a concentration range of 2.00 to 5 wt % and the detergent is present in a concentration range of 0.15 to 5 wt % based on the total weight of the lubricating composition.

17. A method of stabilizing steel-on-paper friction comprising:

providing a transmission with a lubricating composition comprising a major amount of a base oil and an additive composition comprising:

(a) at least one first phosphorus- and boron-containing dispersant in an amount of;

(b) at least one second boron-containing dispersant, free of phosphorus; and (c) at least one metal-containing detergent, wherein the total amount of metal in the lubricating composition is at least about 549 ppm;

lubricating a transmission with the lubricating composition;

wherein the additive composition further comprises one or more of an antioxidant, an extreme pressure additive, a corrosion inhibitor, an antiwear additive, a metal deactivator, an antifoam agent, a viscosity index improver, a pour point depressant, an air entrainment additive, a metallic detergent, and a seal swell agent, and wherein in the lubricating composition, the first dispersant is present in a concentration range of 1 to 5 wt %, the second dispersant is present in a concentration range of 2.00 to 5 wt % and the detergent is present in a concentration range of 0.15 to 5 wt % based on the total weight of the lubricating composition.

18. The method of claim 1, wherein the lubricating composition has a steel-on-steel coefficient of friction $\mu_{(Mid\ Point)}$ of greater than or equal to about 0.13 and wherein the lubricating composition has a steel-on-paper coefficient of friction $\mu_{20}/\mu_{100}$ of less than or equal to about 1.0.

19. The method of claim 1, wherein the total amount of phosphorus and boron present in the lubricating composition is at least about 708 ppm.

20. The method of claim 1, wherein the total amount of phosphorus in the lubricating composition is at least about 300 ppm.

* * * * *